US007712690B2

(12) United States Patent
Johnson et al.

(10) Patent No.: US 7,712,690 B2
(45) Date of Patent: May 11, 2010

(54) EXIT VALVE FOR BLOWING INSULATION MACHINE

(75) Inventors: Michael W. Johnson, Lithopolis, OH (US); Michael E. Evans, Granville, OH (US); Agustin Hernandez, Blacklick, OH (US); Robert J. O'Leary, Newark, OH (US); Christopher M. Relyea, Columbus, OH (US); Brian K. Linstedt, Ostrander, OH (US); Gregory J. Merz, Gahanna, OH (US); Charles R. McKean, Mt. Vernon, OH (US)

(73) Assignee: Owens Corning Intellectual Capital, LLCDE (US)

( * ) Notice: Subject to any disclaimer, the term of this patent is extended or adjusted under 35 U.S.C. 154(b) by 647 days.

(21) Appl. No.: 11/581,660

(22) Filed: Oct. 16, 2006

(65) Prior Publication Data

US 2008/0087751 A1 Apr. 17, 2008

(51) Int. Cl.
*B02C 23/20* (2006.01)

(52) U.S. Cl. ..... 241/60

(58) Field of Classification Search ..... 241/60, 241/277, 278.1, 278.2, 283, 134, 141, 98, 241/136, 29

See application file for complete search history.

(56) References Cited

U.S. PATENT DOCUMENTS

| | | | |
|---|---|---|---|
| 313,251 | A | 3/1885 | Taylor |
| 1,630,542 | A | 5/1927 | Schulz |
| 1,718,507 | A | 6/1929 | Wenzel et al. |
| 1,811,898 | A | 6/1931 | Schur et al. |
| 2,049,063 | A | 7/1936 | Hubbard |
| 2,057,121 | A | 10/1936 | Trevellyan |
| 2,057,122 | A | 10/1936 | Trevellyan |
| 2,193,849 | A | 3/1940 | Whitfield |
| 2,200,713 | A | 5/1940 | Ericson et al. |

(Continued)

FOREIGN PATENT DOCUMENTS

| | | |
|---|---|---|
| DE | 3238492 | 4/1984 |

(Continued)

OTHER PUBLICATIONS

Yasuhiro Nonaka, Chromium and Alloys, 1999, Japanese Journal of Paper Technology vol. 42, No. 1, Abstract.*

(Continued)

*Primary Examiner*—Dana Ross
*Assistant Examiner*—Matthew G Katcoff
(74) *Attorney, Agent, or Firm*—James J. Dottavio; Jason S. Fokens

(57) ABSTRACT

A machine for distributing blowing insulation including a shredding chamber having an outlet end, a plurality of shredders configured to shred and pick apart the blowing insulation, and a discharge mechanism mounted at the outlet end of the shredding chamber and configured for distributing the blowing insulation into an airstream. The discharge mechanism includes housing and a plurality of sealing vane assemblies mounted for rotation. The sealing vane assemblies are configured to seal against the housing as the sealing vane assemblies rotate. The housing includes an eccentric segment extending from the housing. A blower is provided and configured to provide the airstream which flows through the discharge mechanism. The sealing vane assemblies become spaced apart from the housing as the sealing vane assemblies rotate through the eccentric segment.

19 Claims, 6 Drawing Sheets

U.S. PATENT DOCUMENTS 2,235,542 A 3/1941 Wenzel
2,262,094 A 11/1941 Burt
2,273,962 A 2/1942 Hubbard
2,291,871 A * 8/1942 Bokum et al. ..... 406/102
2,308,197 A 1/1943 Meyer
2,311,773 A 2/1943 Patterson
2,355,358 A 8/1944 Anderson
2,404,678 A 7/1946 Erb
2,437,831 A 3/1948 Moore
2,532,318 A 12/1950 Mackey et al.
2,532,351 A 12/1950 Wedebrock
2,550,354 A 4/1951 Jacobsen
2,618,817 A 11/1952 Slayter
2,721,767 A * 10/1955 Kropp ..... 406/101
2,754,995 A 7/1956 Switzer
2,794,454 A 6/1957 Moulthrop
2,869,793 A 1/1959 Montgomery
2,938,651 A 5/1960 Specht et al.
2,964,896 A 12/1960 Finocchiaro
2,984,872 A 5/1961 France
2,989,252 A * 6/1961 Babb ..... 241/138
3,051,398 A 8/1962 Babb
3,076,659 A 2/1963 Kremer
3,175,866 A 3/1965 Nichol
3,201,007 A 8/1965 Transeau
3,231,105 A 1/1966 Easley
3,278,013 A 10/1966 Banks
3,314,732 A 4/1967 Hagan
3,399,931 A 9/1968 Vogt
3,403,942 A * 10/1968 Farnworth ..... 406/65
3,485,345 A 12/1969 Deasy
3,512,345 A 5/1970 Smith
3,556,355 A 1/1971 Ruiz
3,591,444 A 7/1971 Hoppe et al.
3,703,970 A 11/1972 Benson
3,747,743 A 7/1973 Hoffman, Jr.
3,861,599 A 1/1975 Waggoner
3,869,337 A 3/1975 Hoppe et al.
3,895,745 A 7/1975 Hook
3,952,757 A 4/1976 Huey
3,995,775 A 12/1976 Birkmeier et al.
4,059,205 A 11/1977 Heyl
4,129,338 A 12/1978 Mudgett
4,133,542 A 1/1979 Janian et al.
4,134,508 A 1/1979 Burdett, Jr.
4,151,962 A * 5/1979 Calhoun et al. ..... 241/60
4,155,486 A 5/1979 Brown
4,179,043 A 12/1979 Fischer
4,180,188 A 12/1979 Anouma et al.
4,236,654 A 12/1980 Mello
4,268,205 A 5/1981 Vacca et al.
4,273,296 A 6/1981 Hoshall
4,337,902 A 7/1982 Markham
4,344,580 A 8/1982 Hoshall et al.
4,346,140 A 8/1982 Carlson et al.
4,365,762 A 12/1982 Hoshall
4,381,082 A 4/1983 Elliott et al.
4,411,390 A 10/1983 Woten
4,465,239 A 8/1984 Woten
4,536,121 A 8/1985 Stewart et al.
4,537,333 A 8/1985 Bjerregaard
4,560,307 A * 12/1985 Deitesfeld ..... 406/63
4,585,239 A 4/1986 Nicholson
4,640,082 A 2/1987 Gill
4,695,501 A 9/1987 Robinson
4,716,712 A 1/1988 Gill
4,784,298 A 11/1988 Heep et al.
4,880,150 A 11/1989 Navin et al.
4,915,265 A 4/1990 Heep et al.
4,919,403 A 4/1990 Bartholomew
4,978,252 A 12/1990 Sperber
5,014,885 A 5/1991 Heep et al.
5,037,014 A 8/1991 Bliss
5,052,288 A 10/1991 Marquez et al.
5,129,554 A 7/1992 Futamura
5,156,499 A 10/1992 Miklich
5,166,236 A 11/1992 Alexander et al.
5,289,982 A 3/1994 Andersen
5,303,672 A 4/1994 Morris
5,323,819 A 6/1994 Shade
5,368,311 A 11/1994 Heyl
5,380,094 A 1/1995 Schmidt et al.
5,392,964 A 2/1995 Stapp et al.
5,405,231 A 4/1995 Kronberg
5,462,238 A 10/1995 Smith et al.
5,472,305 A 12/1995 Ikeda et al.
5,511,730 A 4/1996 Miller et al.
5,601,239 A 2/1997 Smith et al.
5,620,116 A 4/1997 Kluger et al.
5,624,742 A 4/1997 Babbitt et al.
5,639,033 A 6/1997 Miller et al.
5,642,601 A 7/1997 Thompson, Jr. et al.
5,647,696 A 7/1997 Sperber
5,683,810 A 11/1997 Babbitt et al.
5,819,991 A 10/1998 Khon et al.
5,829,649 A 11/1998 Horton
5,860,232 A * 1/1999 Nathenson et al. ..... 37/466
5,860,606 A 1/1999 Tiedeman et al.
5,927,558 A 7/1999 Bruce
5,934,809 A 8/1999 Marbler
5,987,833 A 11/1999 Heffelfinger et al.
5,997,220 A * 12/1999 Wormser ..... 406/66
6,004,023 A 12/1999 Koyanagi et al.
6,036,060 A 3/2000 Munsch et al.
6,070,814 A 6/2000 Deitesfeld
6,074,795 A 6/2000 Watanabe et al.
6,109,488 A 8/2000 Horton
6,161,784 A 12/2000 Horton
6,209,724 B1 4/2001 Miller
6,266,843 B1 7/2001 Donan et al.
6,296,424 B1 10/2001 Eckel et al.
6,312,207 B1 11/2001 Rautiainen
6,503,026 B1 1/2003 Mitchell
6,510,945 B1 1/2003 Allwein et al.
6,648,022 B2 11/2003 Pentz et al.
6,698,458 B1 3/2004 Sollars
6,779,691 B2 8/2004 Cheng
6,783,154 B2 8/2004 Persson et al.
6,796,748 B1 9/2004 Sperber
6,826,991 B1 12/2004 Ramussen
7,284,715 B2 10/2007 Dziesinski et al.
7,354,466 B2 4/2008 Dunning et al.
2001/0036411 A1 * 11/2001 Walker ..... 417/204
2003/0075629 A1 4/2003 Lucas
2003/0192589 A1 * 10/2003 Jennings ..... 137/115.13
2003/0215165 A1 11/2003 Hogan et al.
2003/0234264 A1 12/2003 Landau
2004/0124262 A1 7/2004 Bowman et al.
2005/0006508 A1 1/2005 Roberts
2005/0242221 A1 11/2005 Rota
2006/0024456 A1 2/2006 O'Leary et al.
2006/0024457 A1 2/2006 O'Leary et al.
2006/0024458 A1 2/2006 O'Leary et al.
2006/0231651 A1 10/2006 Evans et al.
2007/0138211 A1 6/2007 O'Leary et al.
2008/0087751 A1 4/2008 Johnson et al.

FOREIGN PATENT DOCUMENTS

DE 3240126 5/1984
EP 0265751 4/1988
GB 1418882 12/1975
GB 1574027 9/1980
GB 2 099 776 12/1982

| | | |
|---|---|---|
| GB | 2124194 | 2/1984 |
| GB | 2156303 | 10/1985 |
| GB | 2212471 | 7/1989 |
| GB | 2276147 | 9/1994 |
| JP | 407088985 | 4/1995 |
| NL | 8 204 888 | 7/1984 |

OTHER PUBLICATIONS

U.S. Appl. No. 10/899,909—Advisory Action, May 26, 2009.
U.S. Appl. No. 10/899,909—Response to Final, May 12, 2009.
U.S. Appl. No. 10/899,909—Final Rejection, Mar. 20, 2009.
U.S. Appl. No. 10/899,909—Rejection, Sep. 20, 2007.
U.S. Appl. No. 10/899,909—Rejection, Apr. 4, 2008.
U.S. Appl. No. 10/899,909—Rejection, Sep. 9, 2008.
U.S. Appl. No. 10/899,909—Response, Aug. 27, 2007.
U.S. Appl. No. 10/899,909—Response, Dec. 20, 2007.
U.S. Appl. No. 10/899,909—Response, May 16, 2008.
U.S. Appl. No. 10/899,909—Response, Jan. 7, 2009.
U.S. Appl. No. 10/899,909—Restriction, Jul. 31, 2007.
U.S. Appl. No. 11/024,093—3 month office action, Mar. 2, 2007.
U.S. Appl. No. 11/024093—3 month office action, Jul. 12, 2007.
U.S. Appl. No. 11/024,093—3 month office action, Mar. 5, 2009.
U.S. Appl. No. 11/024,093—Advisory Action, Jan. 11, 2008.
U.S. Appl. No. 11/024,093—Final 3 month, Oct. 24, 2007.
U.S. Appl. No. 11/024,093—RCE, Jan. 22, 2008.
U.S. Appl. No. 11/024,093—Response, Jan. 24, 2007.
U.S. Appl. No. 11/024,093—Response, Jun. 4, 2007.
U.S. Appl. No. 11/024,093—Response, Oct. 12, 2007.
U.S. Appl. No. 11/024,093—Response, Dec. 20, 2007.
U.S. Appl. No. 11/024,093—Response, May 28, 2009.
U.S. Appl. No. 11/024,093—Restriction, Nov. 24, 2006.
U.S. Appl. No. 11/303,612, 3 Month, Oct. 15, 2009.
U.S. Appl. No. 11/303,612, Final 3 Month, Apr. 30, 2009.
U.S. Appl. No. 11/452,554—3 Month Office Action, Apr. 8, 2008.
U.S. Appl. No. 11/452,554—Advisory Action, Feb. 6, 2009.
U.S. Appl. No. 11/452,554—Final 3 Month, Oct. 15, 2008.
U.S. Appl. No. 11/452,554—Final 3 Month, May 5, 2009.
U.S. Appl. No. 11/452,554—RCE, Mar. 11, 2009.
U.S. Appl. No. 11/452,554—Response, Jun. 4, 2008.
U.S. Appl. No. 11/452,554—Response After Final, Jan. 14, 2009.
U.S. Appl. No. 11/581,661—3 Month, Apr. 3, 2008.
U.S. Appl. No. 11/581,661—3 Month, May 5, 2009.
U.S. Appl. No. 11/581,661—Advisory Action, Jan. 27, 2009.
U.S. Appl. No. 11/581,661—Final 3 Month, Dec. 3, 2008.
Nonaka-Yasuhiro, Japanese Trade-Journal, Article, Characteristics of Functional Chromium Plating and Its Application, , 1999.
PCT Search Report for PCT/US05/26256 dated Nov. 22, 2005.
PCT Search Report for PCT/US05/27124 dated Nov. 22, 2005.
U.S. Appl. No. 11/303,612—Response, Jan. 14, 2009.
U.S. Appl. No. 11/581,661—Response, Jul. 17, 2008.
U.S. Appl. No. 11/303,612—Response AF, Jun. 29, 2009.
U.S. Appl. No. 11/581,661—Response AF, Jan. 9, 2009.
U.S. Appl. No. 11/581,661—Response; RCE, Feb. 25, 2009.
Hearing Testimony, Case No. 09 CV 263 Division 2, Boulder County District Court, Colorado, Apr. 28, 2009, 11 pages.
Hearing Testimony, Case No. 09 CV 263 Division 2, Boulder County District Court, Colorado, Apr. 29, 2009, 14 pages.
Hearing Testimony, Case No. 09 CV 263 Division 2, Boulder County District Court, Colorado, Apr. 30, 2009, 35 pages.
Hearing Testimony, Case No. 09 CV 263, Boulder County District Court, Colorado, May 1, 2009, 18 pages.
Hearing Testimony, Case No. 09 CV 263 Division 2, Boulder County District Court, Colorado, May 4, 2009, 27 pages.
Hearing Testimony, Case No. 09 CV 263 Division 2, Boulder County District Court, Colorado, May 5, 2009, 5 pages.
Hearing Testimony, Case No. 09 CV 263 Division 2, Boulder County District Court, Colorado, May 7, 2009, 8 pages.
Hearing Testimony, Case No. 09 CV 263 Division K, Boulder County District Court, Colorado, May 7, 2009, 8 pages.
Krendl #425, Krendl Machining Company, Delphos, OH, www.krendlmachine.com, Copyright Jan. 2009, CT000357-CT000358, 2 pages.
Krendl #250A, Krendl Machining Company, Delphos, OH, www.krendlmachine.com, Copyright Apr. 2008, CT000359-CT000360, 2 pages.
Insulation Blowers—Accul 9118, Insulation Machine Corp., Springfield, MA, Copyright 2006, http://accuone.com/accul_9118.html-Apr. 4, 2009, CT0000056-CT0000057, 2 pages.
AccuOne 9400, AccuOne Industries, Inc., Copyright 1998, http://www.accu1.com/A9400.htm1-Jul. 13, 2004, CT0000059, 1 page.
Cocoon Insulation, Cocoon, Charlotte, NC, Copyright 2003 U.S. Green Fiber, LLC and Copright 2003 by Lowe's, CT0000071-CT0000076, 6 pages.
X-Floc Minifant M99, X-Floc GmbH, Renningen, Germany, Mar. 18, 2009, http://www.x-floc.com/en/machines/minifant-m99.htm1-Apr. 6, 2009, CT0000449-CT0000451, 3 pages.
X-Floc Zellofant M95, X-Floc GmbH, Renningen, Germany, Feb. 8, 2009, http://www.x-floc.com/en/machines/zellofant-m95.htm1-Apr. 13, 2009, CT0000107-CT0000112, 6 pages.
Meyer Series 700, "Reliable Hydraulic Power on the Industry's Mot Versatile Platform", Copyright 2007 Wm. W. Meyer & Sons, Inc., Libertyville, IL, www.meyerinsulation.com, CT0000602-CT0000603, 2 pages.

* cited by examiner

EXIT VALVE FOR BLOWING INSULATION MACHINE

RELATED APPLICATIONS

This patent application is related to the following U.S. patent application Ser. No. 11/581,659, filed Oct. 16, 2006, entitled "Agitation System for Blowing Insulation Machine", and now pending, and Ser. No. 11/581,661, filed Oct. 16, 2006, entitled "Entrance Chute for Blowing Insulation Machine, and now pending.

TECHNICAL FIELD

This invention relates to loosefill blowing insulation for insulating buildings. More particularly this invention relates to machines for distributing packaged loosefill blowing insulation.

BACKGROUND OF THE INVENTION

In the insulation of buildings, a frequently used insulation product is loosefill insulation. In contrast to the unitary or monolithic structure of insulation batts or blankets, loosefill insulation is a multiplicity of discrete, individual tufts, cubes, flakes or nodules. Loosefill insulation is usually applied to buildings by blowing the insulation into an insulation cavity, such as a wall cavity or an attic of a building. Typically loosefill insulation is made of glass fibers although other mineral fibers, organic fibers, and cellulose fibers can be used.

Loosefill insulation, commonly referred to as blowing insulation, is typically compressed in packages for transport from an insulation manufacturing site to a building that is to be insulated. Typically the packages include compressed blowing insulation encapsulated in a bag. The bags are made of polypropylene or other suitable material. During the packaging of the blowing insulation, it is placed under compression for storage and transportation efficiencies. Typically, the blowing insulation is packaged with a compression ratio of at least about 10:1. The distribution of blowing insulation into an insulation cavity typically uses a blowing insulation distribution machine that feeds the blowing insulation pneumatically through a distribution hose. Blowing insulation distribution machines typically have a large chute or hopper for containing and feeding the blowing insulation after the package is opened and the blowing insulation is allowed to expand.

It would be advantageous if blowing insulation machines could be improved to make them easier to use.

SUMMARY OF THE INVENTION

The above objects as well as other objects not specifically enumerated are achieved by a machine for distributing blowing insulation. The machine includes a shredding chamber having an outlet end, a plurality of shredders configured to shred and pick apart the blowing insulation, and a discharge mechanism mounted at the outlet end of the shredding chamber and configured for distributing the blowing insulation into an airstream. The discharge mechanism includes a housing and a plurality of sealing vane assemblies mounted for rotation. The sealing vane assemblies are configured to seal against the housing as the sealing vane assemblies rotate. The housing includes an eccentric segment extending from the housing. A blower is provided and configured to provide the airstream which flows through the discharge mechanism. The sealing vane assemblies become spaced apart from the housing as the sealing vane assemblies rotate through the eccentric segment.

According to this invention there is also provided a machine for distributing blowing insulation. The machine includes a shredding chamber having an outlet end, a plurality of shredders configured to shred and pick apart the blowing insulation, and a discharge mechanism mounted at the outlet end of the shredding chamber and having a side inlet. The discharge mechanism is configured for distributing the blowing insulation into an airstream. A blower is provided and configured to provide the airstream which flows through the discharge mechanism. The blowing insulation is fed horizontally from the shredding chamber into the side inlet of the discharge mechanism.

According to this invention there is also provided a machine for distributing blowing insulation. The machine includes a shredding chamber having an outlet end, a plurality of shredders configured to shred and pick apart the blowing insulation, and a discharge mechanism mounted at the outlet end of the shredding chamber and configured for distributing the blowing insulation into an airstream. The discharge mechanism includes a housing, an eccentric segment extending from the housing, and an outlet plate. The eccentric segment defines an eccentric region. The outlet plate includes an outlet opening. A blower is provided and configured to provide the airstream which flows through the discharge mechanism. The outlet opening of the outlet plate includes the eccentric region.

According to this invention there is also provided a machine for distributing blowing insulation. The machine includes a shredding chamber having an outlet end, a plurality of shredders configured to shred and pick apart the blowing insulation, and a discharge mechanism mounted at the outlet end of the shredding chamber and configured for distributing the blowing insulation into an airstream. The discharge mechanism includes a housing and a plurality of sealing vane assemblies mounted for rotation and configured to seal against the housing as the sealing vane assemblies rotate. A blower is provided and configured to provide the airstream which flows through the discharge mechanism. A maximum of four sealing vane assemblies seal against the housing at a time.

According to this invention there is also provided a machine for distributing blowing insulation. The machine includes a shredding chamber having an outlet end, a plurality of shredders configured to shred and pick apart the blowing insulation, and a discharge mechanism mounted at the outlet end of the shredding chamber and configured for distributing the blowing insulation into an airstream. The discharge mechanism includes a plurality of sealing vane assemblies mounted for rotation. The sealing vane assemblies include a sealing core and a plurality of vane support flanges. A blower is provided and configured to provide the airstream which flows through the discharge mechanism. The sealing core is supported by opposing vane support flanges.

Various objects and advantages of this invention will become apparent to those skilled in the art from the following detailed description of the preferred embodiment, when read in light of the accompanying drawings.

DETAILED DESCRIPTION OF THE INVENTION

Figure 1:
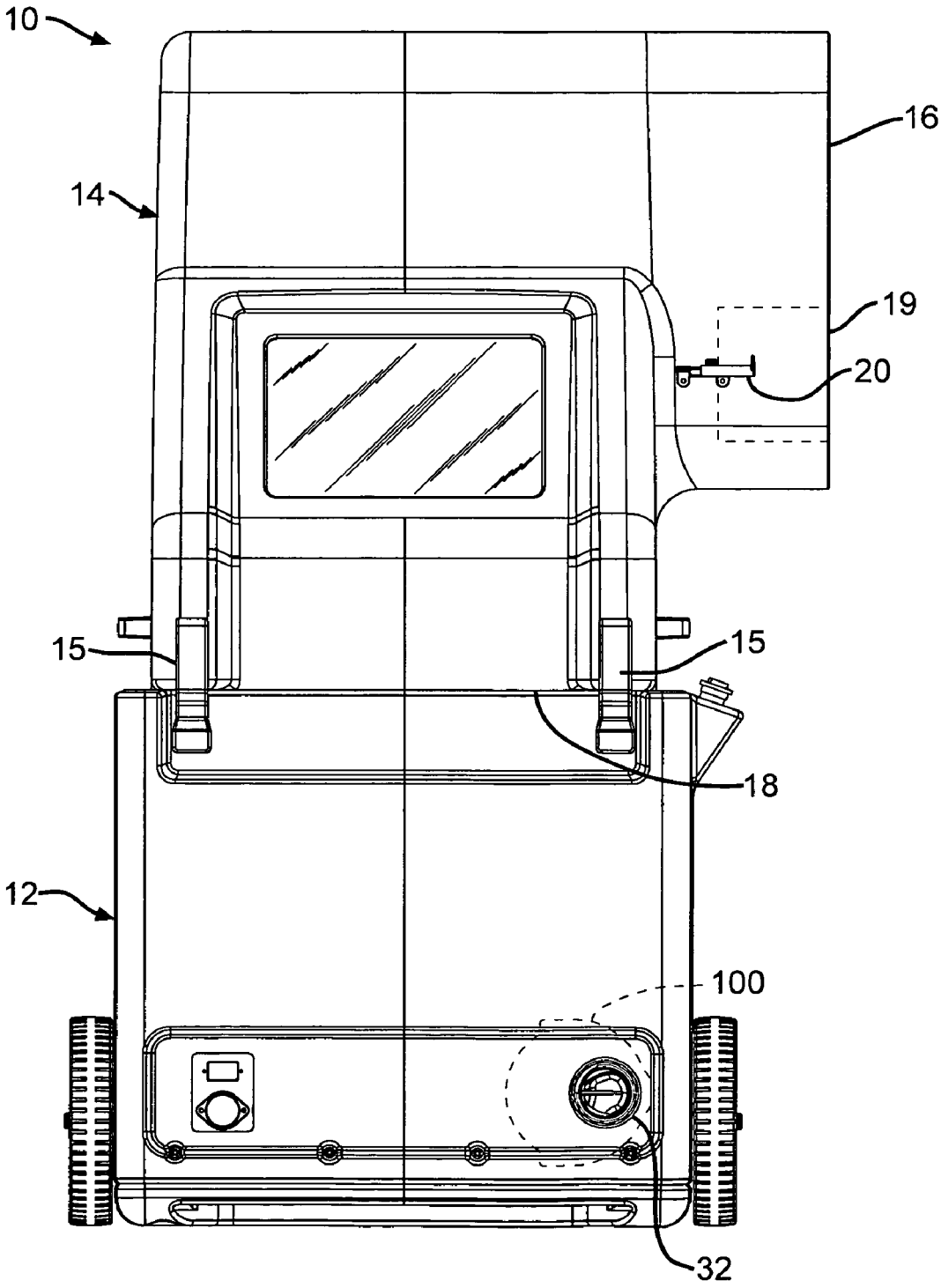
FIG. 1 is a front view in elevation of an insulation blowing insulation machine.
Figure 2:
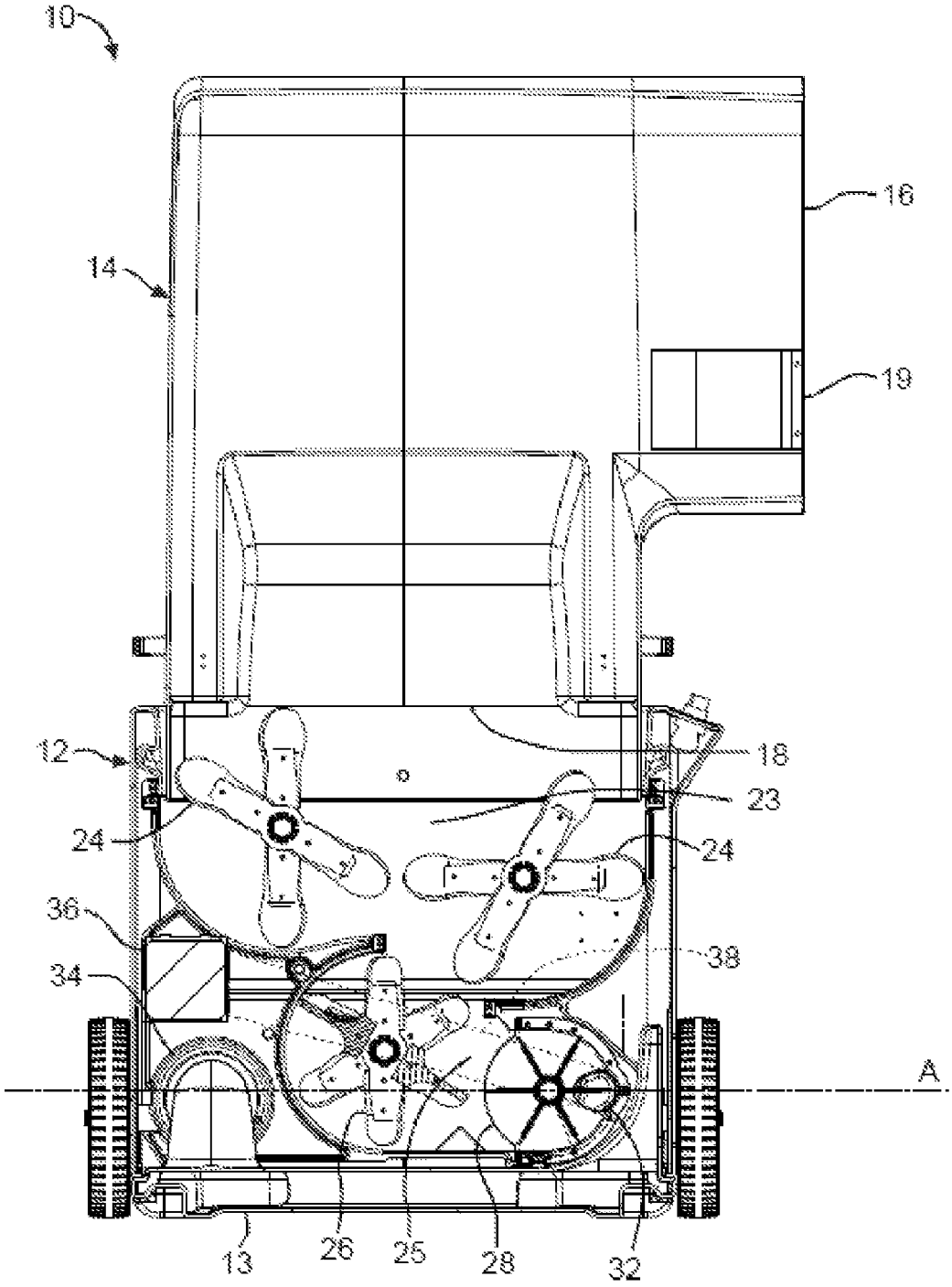
FIG. 2 is a front view in elevation, partially in cross-section, of the insulation blowing insulation machine of FIG. 1.
Figure 3:
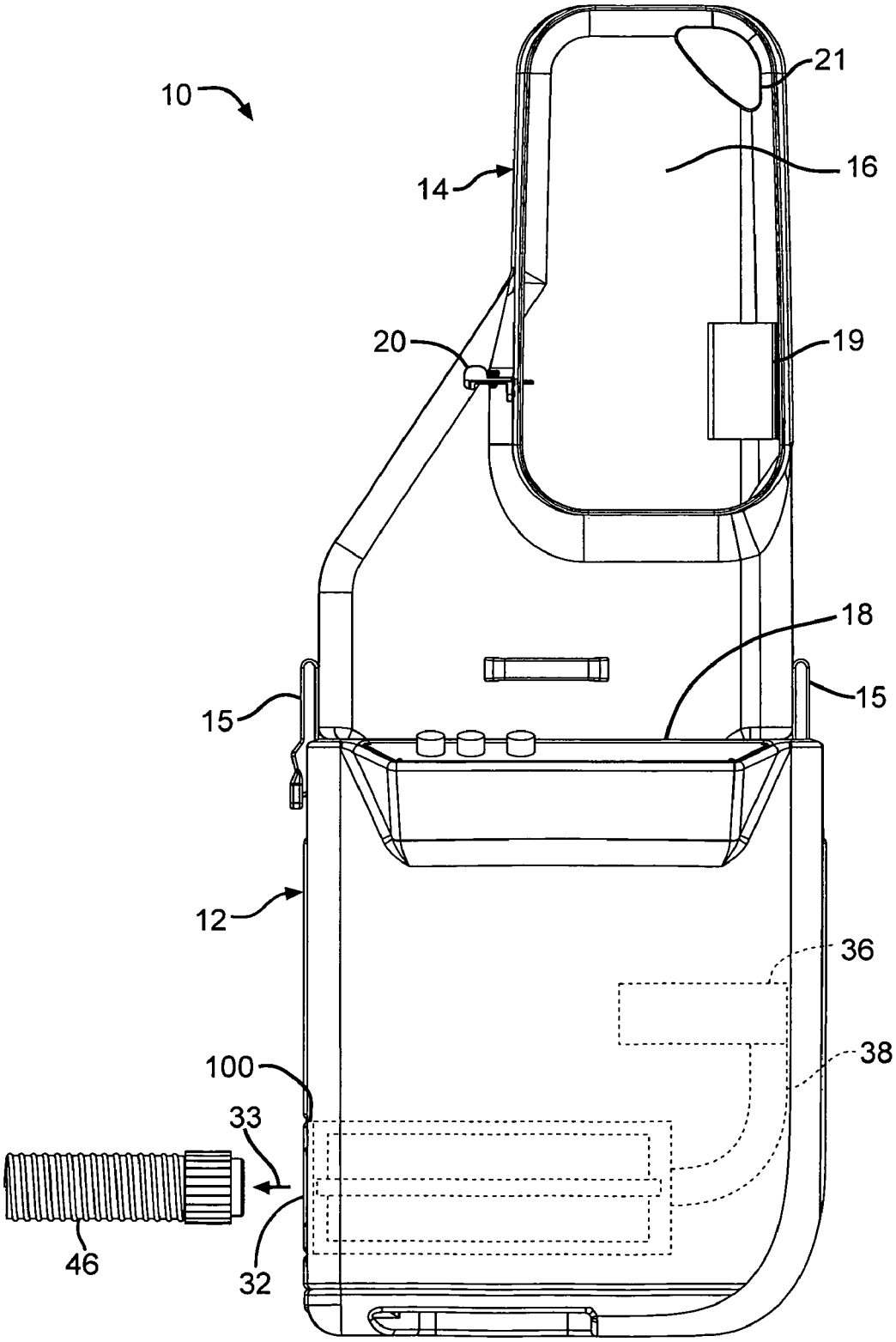
FIG. 3 is a side view in elevation of the insulation blowing insulation machine of FIG. 1.

A blowing insulation machine 10 for distributing blowing insulation is shown in FIGS. 1-3. The blowing insulation machine 10 includes a lower unit 12 and a chute 14. The lower unit 12 is connected to the chute 14 by a plurality of fastening mechanisms 15 configured to readily assemble and disassemble the chute 14 to the lower unit 12. As further shown in FIGS. 1-3, the chute 14 has an inlet end 16 and an outlet end 18.

The chute 14 is configured to receive the blowing insulation and introduce the blowing insulation to the shredding chamber 23 as shown in FIG. 2. Optionally, the chute 14 includes a handle segment 21, as shown in FIG. 3, to facilitate ready movement of the blowing insulation machine 10 from one location to another. However, the handle segment 21 is not necessary to the operation of the machine 10.

As further shown in FIGS. 1-3, the chute 14 includes an optional guide assembly 19 mounted at the inlet end 16 of the chute 14. The guide assembly 19 is configured to urge a package of compressed blowing insulation against a cutting mechanism 20, shown in FIGS. 1 and 3, as the package moves into the chute 14.

As shown in FIG. 2, the shredding chamber 23 is mounted at the outlet end 18 of the chute 14. In this embodiment, the shredding chamber 23 includes a plurality of low speed shredders 24 and an agitator 26. The low speed shredders 24 shred and pick apart the blowing insulation as the blowing insulation is discharged from the outlet end 18 of the chute 14 into the lower unit 12. Although the blowing insulation machine 10 is shown with a plurality of low speed shredders 24, any type of separator, such as a clump breaker, beater bar or any other mechanism that shreds and picks apart the blowing insulation can be used.

As further shown in FIG. 2, the shredding chamber 23 includes an agitator 26 for final shredding of the blowing insulation and for preparing the blowing insulation for distribution into an airstream. In this embodiment as shown in FIG. 2, the agitator 26 is positioned beneath the low speed shredders 24. Alternatively, the agitator 26 can be disposed in any location relative to the low speed shredders 24, such as horizontally adjacent to, sufficient to receive the blowing insulation from the low speed shredders 24. In this embodiment, the agitator 26 is a high speed shredder. Alternatively, any type of shredder can be used, such as a low speed shredder, clump breaker, beater bar or any other mechanism that finely shreds the blowing insulation and prepares the blowing insulation for distribution into an airstream.

In this embodiment, the low speed shredders 24 rotate at a lower speed than the agitator 26. The low speed shredders 24 rotate at a speed of about 40-80 rpm and the agitator 26 rotates at a speed of about 300-500 rpm. In another embodiment, the low speed shredders 24 can rotate at speeds less than or more than 40-80 rpm and the agitator 26 can rotate at speeds less than or more than 300-500 rpm.

Referring again to FIG. 2, a discharge mechanism 28 is positioned adjacent to the agitator 26 and is configured to distribute the finely shredded blowing insulation into the airstream. In this embodiment, the shredded blowing insulation is driven through the discharge mechanism 28 and through a machine outlet 32 by an airstream provided by a blower 36 mounted in the lower unit 12. The airstream is indicated by an arrow 33 in FIG. 3. In another embodiment, the airstream 33 can be provided by another method, such as by a vacuum, sufficient to provide an airstream 33 driven through the discharge mechanism 28. In this embodiment, the blower 36 provides the airstream 33 to the discharge mechanism 28 through a duct 38 as shown in FIG. 2. Alternatively, the airstream 33 can be provided to the discharge mechanism 28 by another structure, such as by a hose or pipe, sufficient to provide the discharge mechanism 28 with the airstream 33.

The shredders 24, agitator 26, discharge mechanism 28 and the blower 36 are mounted for rotation. They can be driven by any suitable means, such as by a motor 34, or other means sufficient to drive rotary equipment. Alternatively, each of the shredders 24, agitator 26, discharge mechanism 28 and the blower 36 can be provided with its own motor.

In operation, the chute 14 guides the blowing insulation to the shredding chamber 23. The shredding chamber 23 includes the low speed shredders 24 which shred and pick apart the blowing insulation. The shredded blowing insulation drops from the low speed shredders 24 into the agitator 26. The agitator 26 prepares the blowing insulation for distribution into the airstream 33 by further shredding the blowing insulation. The finely shredded blowing insulation exits the agitator 26 at an outlet end 25 of the shredding chamber 23 and enters the discharge mechanism 28 for distribution into the airstream 33 provided by the blower 36. The airstream 33, with the shredded blowing insulation, exits the machine 10 at the machine outlet 32 and flows through the distribution hose 46, as shown in FIG. 3, toward the insulation cavity, not shown.

Figure 4:
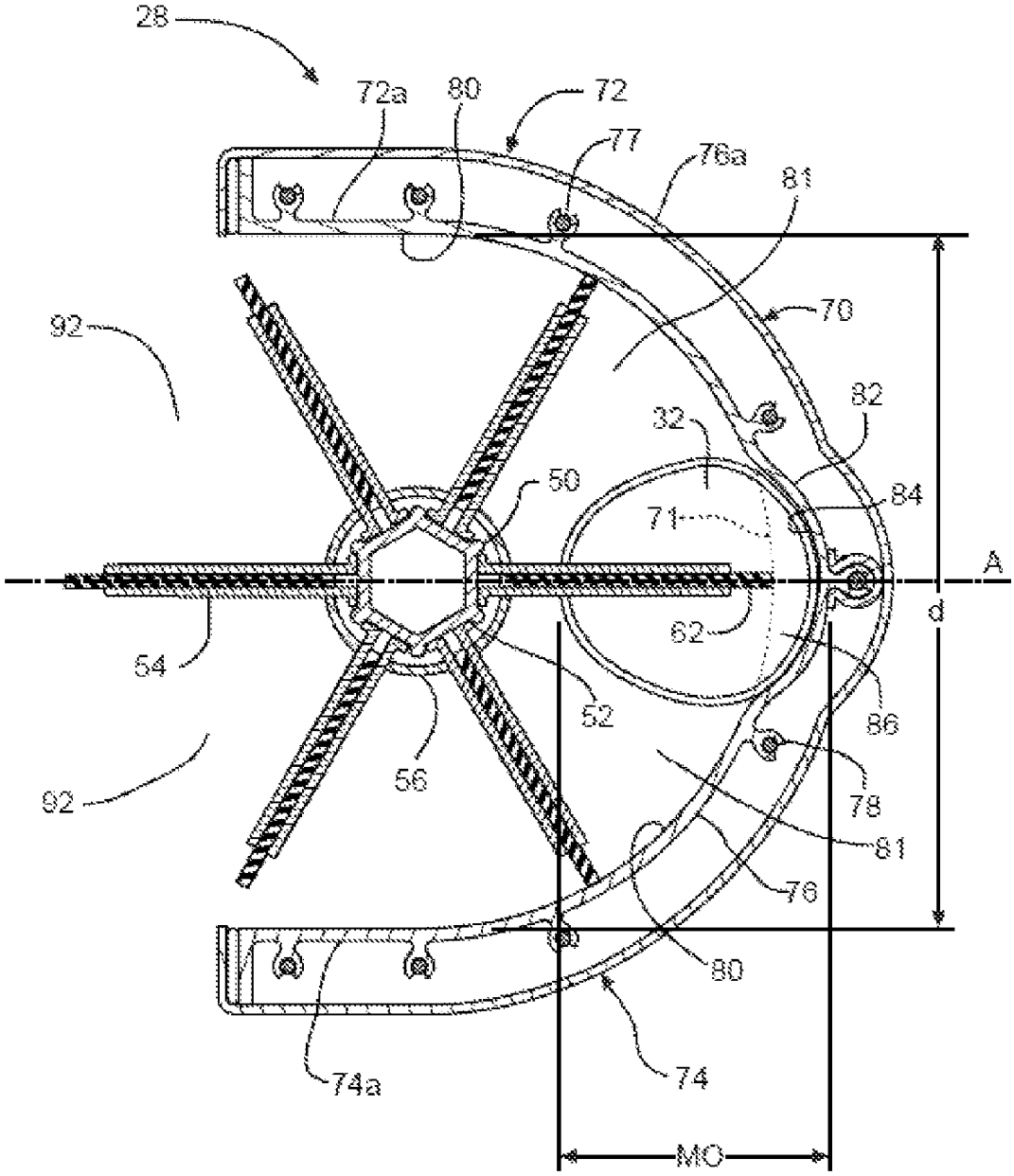
FIG. 4 is a cross-sectional view in elevation of a discharge mechanism of the insulation blowing insulation machine of FIG. 1.

As previously discussed and as shown in FIG. 4, the discharge mechanism 28 is configured to distribute the finely shredded blowing insulation into the airstream 33. In this embodiment, the discharge mechanism 28 is a rotary valve. Alternatively the discharge mechanism 28 can be any other mechanism including staging hoppers, metering devices, rotary feeders, sufficient to distribute the shredded blowing insulation into the airstream 33.

As shown in FIG. 4, the discharge mechanism 28 includes a valve shaft 50 mounted for rotation. In this embodiment, the valve shaft 50 is a hollow rod having a hexagonal cross-sectional shape. The valve shaft 50 is configured with flat hexagonal surfaces 52 which are used to seat a plurality of sealing vane assemblies 54. Alternatively, other cross-sectional shapes, such as a pentagonal cross-sectional shape, can be used.

In this embodiment the valve shaft 50 is made of steel, although the valve shaft 50 can be made of other materials, such as aluminum or plastic, or other materials sufficient to allow the valve shaft 50 to rotate with the seated sealing vane assemblies 54.

Figure 5:
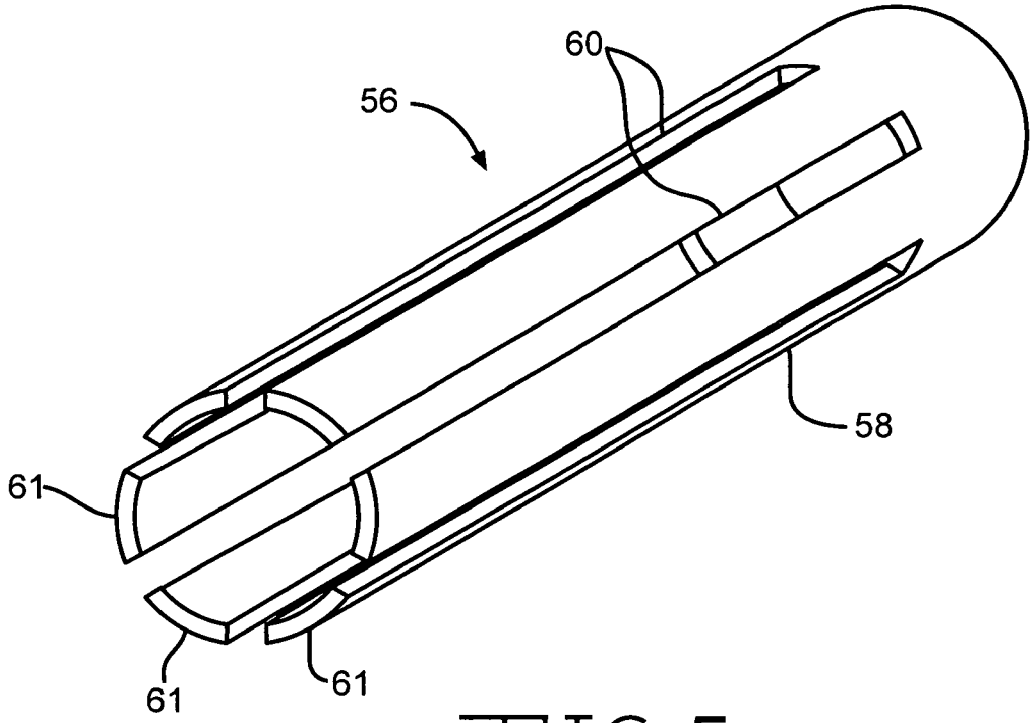
FIG. 5 is a perspective view of a shaft lock of the insulation blowing insulation machine of FIG. 1.

A plurality of sealing vane assemblies 54 are attached to the valve shaft 50 by positioning them against the flat hexagonal surface 52 of the valve shaft 50 and holding them in place by a shaft lock 56. In this embodiment as shown in FIG. 5, the shaft lock 56 includes a shaft tube 58 having a plurality of slots 60 and alternate tangs 61. The slots 60 and alternate tangs 61 extend substantially along the length of the shaft lock 56. As will be discussed in more detail later, the slot 60 of the shaft lock 56 slides onto the sealing vane assembly 54 and thereby seats the sealing vane assembly 54 against the hexagonal surfaces 52 of the valve shaft 50. In another embodiment, the valve shaft 50 and the shaft lock 56 may be a single member, such as an extrusion, such that the slots 60 slide onto the sealing vane assembly 54 and are thereby seated against the hexagonal surfaces 52 of the valve shaft. In this embodiment, the shaft lock 56 includes a tube having a plurality of slots 60 and alternate tangs 61. Alternatively, the sealing vane assemblies 54 could be attached to the valve shaft 50 by other fastening mechanisms, such as clamps, clips, bolts, sufficient to attach the sealing vane assemblies 54 to the valve shaft 50. In this embodiment, the sealing vane assemblies 54 are seated against flat hexagonal surfaces 52 of the valve shaft 50 and fixed by the shaft lock 56. In operation, the machine operator can remove the sealing vane assemblies 54, the valve shaft 50 and the shaft lock 56 from the discharge mechanism 28 as a unit, thereby making maintenance and repair simpler.

Figure 6:
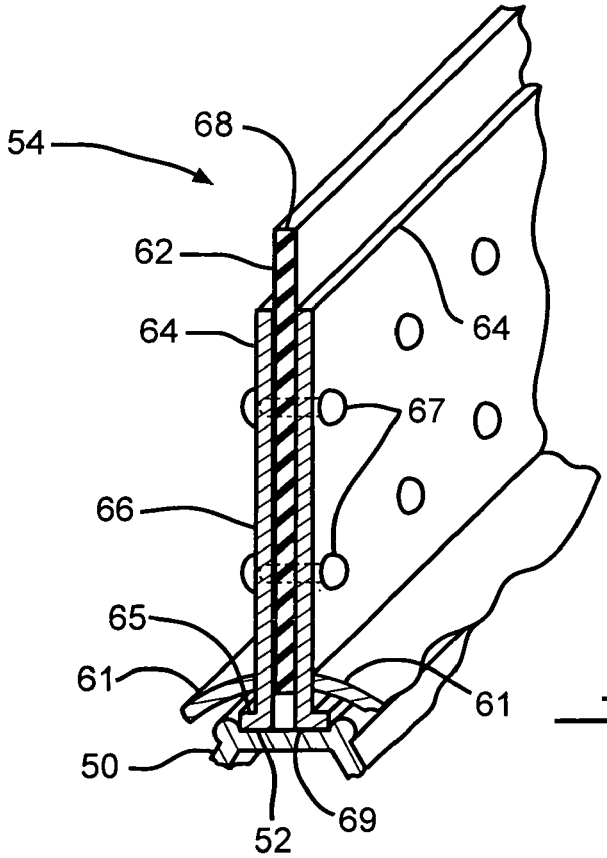
FIG. 6 is a perspective view of a sealing vane assembly of the blowing insulation machine of FIG. 1.

As previously mentioned, the discharge mechanism 28 includes a plurality of sealing vane assemblies 54. As shown in FIG. 6, the sealing vane assemblies 54 include a sealing core 62 disposed between two opposing vane supports 64. The sealing core 62 includes a vane tip 68 positioned at the outward end of the sealing core 62. As shown in FIG. 4, the sealing vane assembly 54 is configured such that the vane tip 68 seals against a valve housing 70 as the sealing vane assembly 54 rotates within the valve housing 70. In this embodiment, the sealing core 62 is made from fiber-reinforced rubber. In another embodiment, the sealing core 62 can be made of other materials, such as polymer, silicone, felt, or other materials sufficient to seal against the valve housing 70. In this embodiment, the fiber-reinforced sealing core 62 has a hardness rating of about 50 A to 70 A as measured by a Durometer. The hardness rating of about 50 A to 70 A allows the sealing core 62 to efficiently seal against the valve housing 70 as the sealing vane assembly 54 rotates within the valve housing 70.

As further shown in FIG. 6, each vane support 64 includes a vane support base 65 and a vane support flange 66. The vane support bases 65 of the opposing vane supports 64 combine to form a T-shaped base 69 for each sealing vane assembly 54. As previously discussed, the T-shaped base 69 seats on the flat hexagonal surface 52 of the valve shaft 50. The tangs 61 of the shaft lock 56 hold the T-shaped base 69 of the sealing vane assembly 54 against the hexagonal surface 52 of the valve shaft 50.

In this embodiment as shown in FIG. 6, the sealing core 62 is attached to the vane support flanges 66 by a plurality of vane rivets 67. Alternatively, the sealing core 62 can be attached to the vane support flanges 66 by sonic welding, adhesives, mechanical fasteners, or other fastening methods sufficient to attach the sealing core 62 to the vane support flanges 66. As shown in FIG. 6, the vane support flanges 66 are made of ABS plastic. In another embodiment, the vane support flanges 66 can be made of other materials, including extruded aluminum or brass, sufficient to support the sealing core 62 as the sealing vane assembly 54 rotates within the valve housing 70.

Referring again to FIG. 4, the sealing vane assemblies 54, attached to the valve shaft 50 by the shaft lock 56, rotate within the valve housing 70. In this embodiment, the valve housing 70 is made from an aluminum extrusion, although the valve housing 70 can be made from other materials, including brass or plastic, sufficient to form a housing within which sealing vane assemblies 54 rotate. In this embodiment as shown in FIG. 4, the valve housing 70 includes a top housing segment 72 and a bottom housing segment 74. In another embodiment, the valve housing 70 can be made of a single segment or the valve housing 70 can be made of more than two segments.

As shown in FIG. 4, the valve housing includes an inner housing wall 76 and an optional outer housing wall 76*a*. The inner housing wall 76 having an inner housing surface 80. In this embodiment, the inner housing surface 80 is coated with a chromium alloy to provide a low friction and extended wear surface. Alternatively, the inner housing surface 80 may not be coated with a low friction and extended wear surface or the inner housing surface 80 may be coated with other materials, such as a nickel alloy, sufficient to provide a low friction, extended wear surface.

The top housing segment 72 and the bottom housing segment 74 are attached to the lower unit 12 by housing fasteners 78. In this embodiment, the housing fasteners 78 are bolts extending through mounting holes 77 disposed in the top housing segment 72 and the bottom housing segment 74. In another embodiment, the top housing segment 72 and the bottom housing segment 74 can be attached to the lower unit 12 by other mechanical fasteners, such as clips or clamps, or by other fastening methods including sonic welding or adhesive.

In this embodiment as shown in FIG. 4, the valve housing 70 is curved and extends to form an approximate semi-circular shape. The semi-circular shape of the valve housing 70 has an approximate inside diameter d which is approximately the same diameter of an arc 71 formed by the vane tips 68 of the rotating sealing vane assemblies 54. In operation, the vane tips 68 of the sealing vane assemblies 54 seal against the inner housing surface 80 such that finely shredded blowing insulation entering the discharge mechanism 28 is contained within a wedge-shaped space 81 defined by adjacent sealing vane assemblies 54 and the inner housing surface 80.

Figure 7:
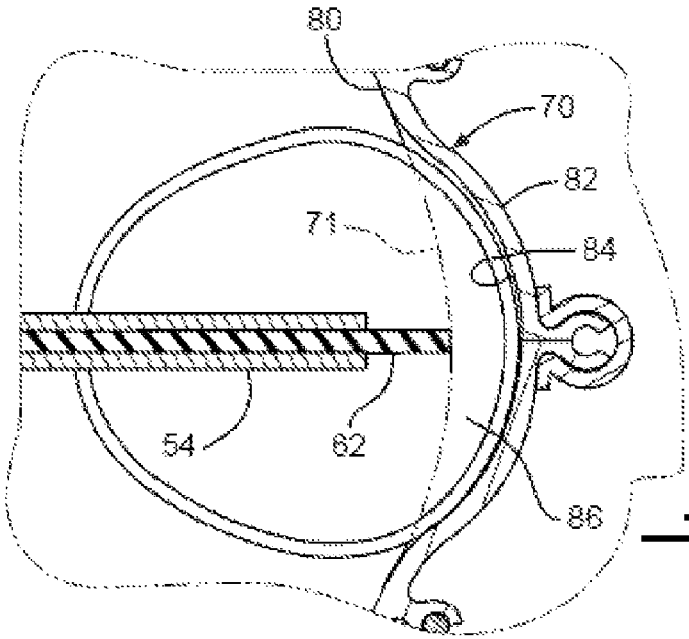
FIG. 7 is a cross-sectional view in elevation of the airstream and eccentric region of the blowing insulation machine of FIG. 1.

As shown in FIGS. 4 and 7, the valve housing 70 includes an eccentric segment 82. The eccentric segment 82 extends from or bulges out from the semi-circular shape of the top housing segment 72 and the bottom housing segment 74. In this embodiment, the eccentric segment 82 has an approximate cross-sectional shape of a dome. Alternatively, the eccentric segment 82 can have any cross-section shape that extends from the top housing segment 72 and the bottom housing segment 74. The eccentric segment 82 includes an inner eccentric surface 84. As shown in FIG. 7, the eccentric segment 82 forms an eccentric region 86 which is defined as the area bounded by the inner eccentric surface 84 and the arc 71 formed by the vane tips 68 of the rotating sealing vane assemblies 54. The eccentric region 86 is within the airstream 33 flowing through the discharge mechanism 28 and forms a portion of the machine outlet 32. In operation, as a sealing vane assembly 54 rotates into the airstream 33, the vane tip 68 of the sealing vane assembly 54 becomes spaced apart from the inner housing surface 80 of the valve housing 70. As the sealing vane assembly 54 further rotates within the eccentric region 86, the airstream 33 flows along the vane tip 68, thereby forcing any particles of blowing wool caught on the vane tip 68 to be blown off. This clearing of the sealing vane assembly 54 prevents a buildup of shredded blowing wool from forming on the sealing vane assembly 54. As shown in FIG. 4, the machine outlet 32, including the eccentric region 86, has a major dimension mo. The major dimension mo of the machine outlet 32 is symmetric about an axis A. In the illustrated embedment, the axis A is parallel to a floor 13 of the lower unit 12 as best shown in FIG. 2.

Referring again to FIG. 4, the top and bottom housing segments 72 and 74 do not completely enclose the valve housing 70, and valve housing 70 includes a side inlet 92. In this embodiment, the side inlet 92 of the valve housing 70 has an approximate length equal to the diameter d of the valve housing 70. Alternatively, the side inlet 92 of the valve housing 70 can have an approximate length that is more or less than the diameter d of the valve housing 70. As shown in FIG. 4 in this embodiment, the sealing vane assemblies 54, the valve housing 70, the eccentric region 86 and the side inlet 92 of the valve housing 70 are configured such that as the sealing vane assemblies 54 rotate, the vane tips 68 of no more than four sealing vane assemblies 54 are in contact with the valve housing 70 at any given time. The remaining vane tips 68 of the sealing vane assemblies 54 are disposed either in the side inlet 92 of the valve housing 70 or in the eccentric region 86. By limiting the number of sealing vane assemblies 54 in contact with the valve housing 70, the resulting drag on the valve shaft 50 is reduced, thereby enabling a minimizing of the size of the drive motor 34. In another embodiment, the number of eccentric regions 86 and the number of sealing vane assemblies 54, as well as the size of the side inlet 92 can be varied to allow more or less sealing vane assemblies 54 to be in contact the valve housing 70 at a given time.

In this embodiment as further shown in FIG. 4, the top housing segment 72 and the bottom housing segment 74 have optional straight portions 72*a* and 74*a* respectively, extending from the curved portions of the top and bottom housing segments 72 and 74. The straight portions 72*a* and 74*a* are configured such that as the sealing vane assemblies 54 rotate, the vane tips 68 are spaced apart from the straight portions 72*a* and 74*a*. In another embodiment, the top and bottom housing segments 72 and 74 can have extended segments configured in another shape, such as an outwardly extending arc, sufficient to be spaced apart from the vane tips 68 as the sealing vane assemblies 54 rotate.

As previously discussed and as further shown in FIG. 4, the top and bottom housing segments 72 and 74 do not completely enclose the valve housing 70 and the valve housing 70 includes a side inlet 92. The side inlet 92 is configured to receive the finely shredded blowing wool as it is fed from the agitator 26. Positioning the side inlet 92 of the discharge mechanism 28 at the side of the discharge mechanism 28 allows finely shredded blowing wool to be fed approximately horizontally into the discharge mechanism 28. Horizontal feeding of the blowing wool from the agitator 26 to the discharge mechanism 28 is defined to include the feeding of blowing wool in a direction that is substantially parallel to the floor 13 of the lower unit 12 as best shown in FIG. 2. Feeding finely shredded blowing wool horizontally into the discharge mechanism 28 allows the discharge mechanism 28 to be positioned at a lower location within the lower unit 12, thereby allowing the blowing wool machine 10 to be more compact. In this embodiment, the agitator 26 is positioned to be adjacent to the side inlet 92 of the discharge mechanism 28. In another embodiment, a low speed shredder 24, or a plurality of shredders 24 or agitators 26, or another mechanism can be adjacent to the side inlet 92, such that finely shredded blowing wool is fed horizontally into the side inlet 92.

Figure 8:
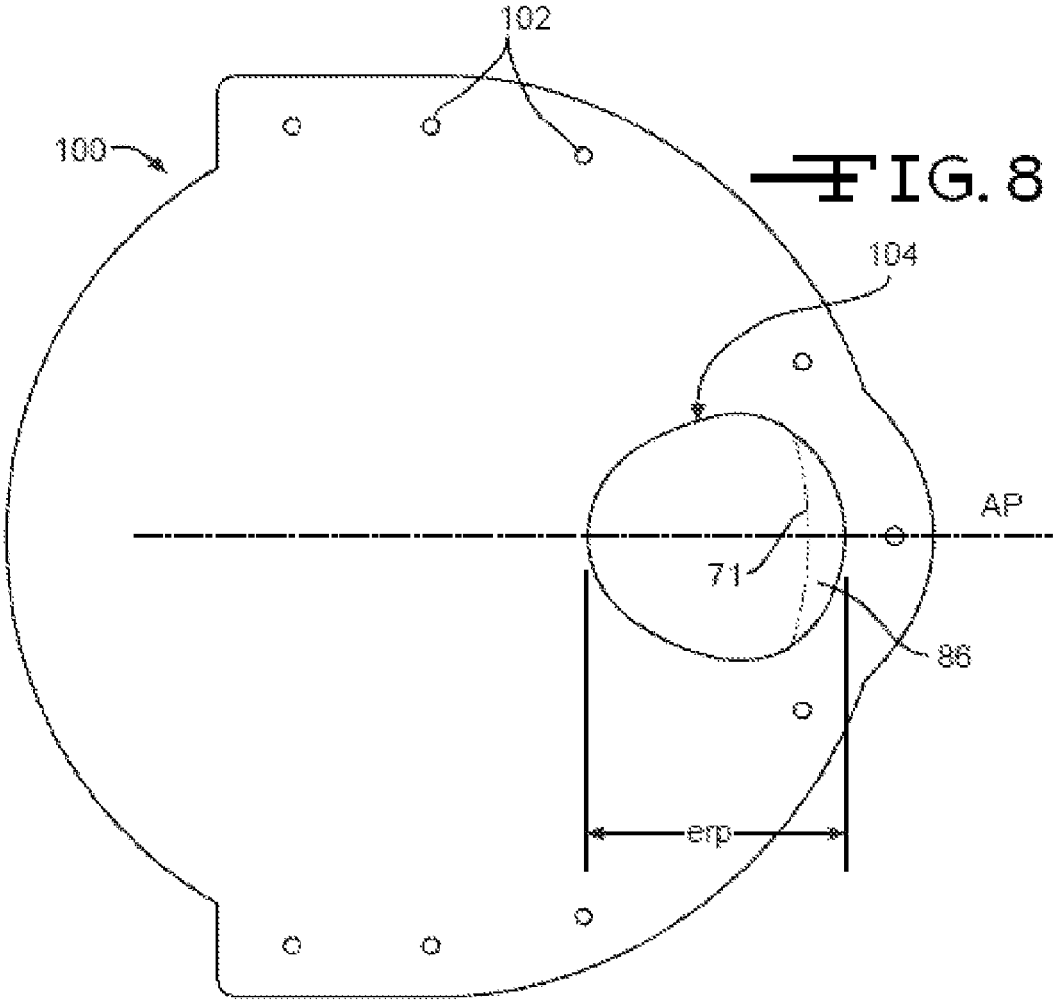
FIG. 8 is a side view in elevation of an end outlet plate of the blowing insulation machine of FIG. 1.

The discharge mechanism 28 further includes an end outlet plate 100 as shown in FIGS. 1 and 8. The end outlet plate 100 covers the outlet end of the discharge mechanism 28 at the machine outlet 32. The end outlet plate 100 includes optional mounting holes 102 and an airstream opening 104. In this embodiment, the airstream opening 104 includes the eccentric region 86. In another embodiment, the airstream opening 104 can be any shape sufficient to discharge shredded blowing wool from the discharge mechanism 28. As shown in FIG. 8, the opening 104, including the eccentric region 86, has a major dimension erp. The major dimension erp of the opening 104 is symmetric about an axis AP. In the illustrated embodiment, the axis AP is parallel to the floor 13 of the lower unit 12.

The blowing insulation used with the machine of the present invention can be any loose fill insulation, such as a multiplicity of discrete, individual tuffs, cubes, flakes, or nodules. The blowing insulation can be made of glass fibers or other mineral fibers, and can also be organic fibers or cellulose fibers. Typically, the loose fill insulation is made of glass fibers although other insulation materials such as rock wool, mineral fibers, organic fibers, polymer fibers, inorganic material, and cellulose fibers. Other particulate matter, such as particles of foam, may also be used. Combinations of any of the aforementioned materials are another alternative. The blowing insulation can have a binder material applied to it, or it can be binderless.

The principle and mode of operation of this blowing insulation machine have been described in its preferred embodiments. However, it should be noted that the blowing insulation machine may be practiced otherwise than as specifically illustrated and described without departing from its scope.

What is claimed is:

1. A machine for distributing blowing insulation comprising:

a shredding chamber having an outlet end, the shredding chamber including a plurality of shredders configured to shred and pick apart the blowing insulation;

a discharge mechanism mounted at the outlet end of the shredding chamber, the discharge mechanism configured for distributing the blowing insulation into an airstream, the discharge mechanism including a housing and a plurality of sealing vane assemblies mounted for rotation, the sealing vane assemblies being configured to seal against the housing as the sealing vane assemblies rotate, the housing including an eccentric segment extending from the housing, the eccentric segment forming an eccentric region, the eccentric region forming a portion of a machine outlet, the machine outlet having a major dimension, the major dimension of the machine outlet being symmetric about an axis, wherein the axis is parallel to a floor of the machine; and a blower configured to provide the airstream flowing through the discharge mechanism;

wherein the sealing vane assemblies become spaced apart from the housing as the sealing vane assemblies rotate through the eccentric segment.

2. The machine of claim 1 in which the housing is curved and extends to form an approximate semi-circle.

3. The machine of claim 2 in which the housing includes straight portions at each end of the semi-circle.

4. The machine of claim 1 in which the housing comprises at least two segments.

5. The machine of claim 1 in which the rotating sealing vane assemblies have tips which define an arc, and the eccentric segment includes an inner eccentric surface, wherein the eccentric region is the area between the arc and the inner eccentric surface of the eccentric segment.

6. The machine of claim 1 in which the eccentric portion is dome shaped.

7. The machine of claim 1 in which the housing includes an inner housing surface which is a low friction surface.

8. A machine for distributing blowing insulation comprising:

a shredding chamber having an outlet end, the shredding chamber including a plurality of shredders configured to shred and pick apart the blowing insulation;

a discharge mechanism mounted at the outlet end of the shredding chamber, the discharge mechanism having a side inlet and configured for distributing the blowing insulation into an airstream; and a blower configured to provide the airstream flowing through the discharge mechanism;

wherein the blowing insulation is fed horizontally from the shredding chamber into the side inlet of the discharge mechanism; and wherein the discharge mechanism has a housing having a diameter, wherein the vertical length of the side inlet is equal to the diameter of the housing.

9. The machine of claim 8 in which the shredding chamber includes an agitator, wherein the agitator is disposed adjacent to the side inlet of the discharge mechanism.

10. The machine of claim 9 in which the agitator disposed adjacent to the side inlet of the discharge mechanism is a high speed agitator.

11. The machine of claim 10 in which the agitator rotates at a speed of about 300-500 rpm.

12. A machine for distributing blowing insulation comprising:

a shredding chamber having an outlet end, the shredding chamber including a plurality of shredders configured to shred and pick apart the blowing insulation;

a discharge mechanism mounted at the outlet end of the shredding chamber and configured for distributing the blowing insulation into an airstream, the discharge mechanism including a housing, an eccentric segment extending from the housing and an outlet plate, the eccentric segment defining an eccentric region, the outlet plate including an outlet opening, the opening having a major dimension, the major dimension being symmetric about an axis, wherein the axis is parallel to a floor of the machine; and a blower configured to provide the airstream flowing through the discharge mechanism;

wherein the outlet opening of the outlet plate includes the eccentric region.

13. A machine for distributing blowing insulation from a bag of compressed blowing insulation, the machine comprising:

a shredding chamber having an outlet end, the shredding chamber including a plurality of shredders configured to shred and pick apart the blowing insulation; and a discharge mechanism mounted to the outlet end of the shredding chamber and configured for distributing the blowing insulation into an airstream, the discharge mechanism including a housing and a plurality of sealing vane assemblies mounted for rotation, the sealing vane assemblies being configured to seal against the housing as the sealing vane assemblies rotate, the housing having curved portions and straight portions, the curved portions extend to form a semi-circle and the straight portions extend from the semi-circle formed by the curved portions; and a blower configured to provide the airstream flowing through the discharge mechanism;

wherein the curved and straight portions of the housing are configured such that a maximum of four sealing vane assemblies seal against the housing at a time.

14. The machine of claim 13 in which the housing includes an inner housing surface, the inner housing surface having a chromium alloy coating.

15. A machine for distributing blowing insulation from a bag of compressed blowing insulation, the machine comprising:

a shredding chamber having an outlet end, the shredding chamber including a plurality of shredders configured to shred and pick apart the blowing insulation;

a discharge mechanism mounted at the outlet end of the shredding chamber and configured for distributing the blowing insulation into an airstream, the discharge mechanism including a plurality of sealing vane assemblies mounted for rotation, the sealing vane assemblies including a sealing core and a plurality of vane support flanges; and a blower configured to provide the airstream flowing through the discharge mechanism;

wherein the sealing core is supported by opposing vane support flanges, the vane support flanges being connected to vane support bases, wherein the vane support flanges and the vane support bases combine to form T-shaped bases.

16. The machine of claim 15 in which the sealing vane assemblies are mounted on a vane shaft, the vane shaft having a diameter and a length, wherein the vane shaft includes a plurality of parallel slots extending substantially the length of the vane shaft.

17. The machine of claim 15 in which the T-shaped base of the sealing vane assemblies are fitted into the slots in the vane shaft.

18. The machine of claim 15 in which the sealing vane assemblies include sealing cores, wherein the sealing cores are made of fiber-reinforced rubber.

19. The machine of claim 18 in which the sealing cores have a hardness rating of about 50 A to 70 A Durometer.

* * * * *